United States Patent [19]

Obersby

[11] 4,305,898

[45] Dec. 15, 1981

[54] METHOD FOR THE MANUFACTURE OF A BONDED ABRASIVE GRINDING PRODUCT

[75] Inventor: Derek Obersby, Little Haywood, England

[73] Assignee: Unicorn Industries Limited, Windsor, England

[21] Appl. No.: 57,796

[22] Filed: Jul. 16, 1979

[30] Foreign Application Priority Data

Jul. 17, 1978 [GB] United Kingdom ..... 30117/78

[51] Int. Cl.[3] ..... H05B 6/64

[52] U.S. Cl. ..... 264/25; 51/298; 51/307; 51/308; 264/22; 264/26

[58] Field of Search ..... 51/307, 308, 298, 293; 264/22, 27, 25, 26

[56] References Cited

U.S. PATENT DOCUMENTS

| | | | |
|---|---|---|---|
| 2,332,241 | 10/1943 | Lombard et al. | 51/308 |
| 3,471,277 | 10/1969 | Ackermann | 51/308 |
| 3,939,612 | 2/1976 | Peterson | 51/308 |
| 3,950,148 | 4/1976 | Fukuda | 51/297 |
| 3,950,149 | 4/1976 | Fukuda | 51/298 R |
| 4,115,077 | 9/1978 | Fukuda | 51/298 R |
| 4,150,514 | 4/1979 | Douglass | 51/298 |

FOREIGN PATENT DOCUMENTS

| | | |
|---|---|---|
| 1001818 | 1/1957 | Fed. Rep. of Germany . |
| 547562 | 9/1942 | United Kingdom . |

*Primary Examiner*—Donald E. Czaja
*Assistant Examiner*—W. Thompson
*Attorney, Agent, or Firm*—LeBlanc, Nolan, Shur & Nies

[57] ABSTRACT

In the manufacture of grinding wheels or other grinding products of either the vitrified or organic type, the heat treatment for drying and/or firing or curing respectively is provided by microwave energy so that the heating is progressive from the inside of the wheel to the outside and the process is greatly speeded up. It is also possible according to the invention to include a steel or other metallic reinforcing ring in a grinding wheel without it being damaged or destroyed during firing.

13 Claims, 4 Drawing Figures

METHOD FOR THE MANUFACTURE OF A BONDED ABRASIVE GRINDING PRODUCT

This invention relates to grinding products, and more particularly but not solely, to grinding wheels, and is especially concerned with methods of manufacture thereof.

The term grinding products, as used herein, is intended to embrace not only grinding wheels, but also grinding sticks, stones, blocks and segments, and mounted points, all of which are characterised by abrasive material in powder or granulated form dispersed in a matrix and being in the form of a body of the matrix material of shape and dimensions to suit the duty for which the product is designed.

Grinding products fall into two major classes by composition of the matrix namely vitrified and organic, and the present invention is applicable in general terms, to products of both classes, although it will be understood that the working parameters will be different in each case.

In the manufacture of vitrified grinding products, an abrasive material is intimately mixed with the bonding ingredients and a temporary binder. The bonding ingredients consist of such compounds as are necessary to combine to form the required vitreous bond during firing and are mixtures of clays, such as ball clay, frits and fluxes to form a wet mixture and this mixture is pressed into the required shape. The green product is then placed in a drying oven for a period of several days in order to achieve a slow drying to prevent damage to the product. Following this process the dried, but still green, product is passed into a kiln for firing so that the dried bond forms a vitreous matrix for the abrasive particles. This process is also a long, slow business to ensure that the products do not become damaged during firing.

Typical timing for a grinding wheel is 84 hours for drying and 132 hours for firing.

Thus, it will be seen that the process of manufacturing grinding products, particularly grinding wheels entails the use of large drying ovens and kilns with a total capacity of several days production, with a consequent large space requirement; considerable handling of the products, which entails labour costs; and also the energy requirements are enormous. The products have to be supported on so-called kiln or oven furniture and the heating and subsequent cooling of this adds to the energy requirement. Further, the long time of processing also leads to capital requirements to finance the products actually in course of manufacture in addition to normal stocks which may be carried.

Organic grinding products include wheels and other products with rubber and resinoid matrices and in the so-called resinoid grinding products the abrasive material is dispersed in a matrix of thermosetting resin, and in some cases a thermoplastic resin, and because of the bulk of the product, the curing has to be effected slowly, e.g. for a grinding wheel, over a period of 24 to 36 hours.

A grinding wheel is principally a high density short hollow cylinder which contains even in its "green" state, tensile, radial and axial stress.

Normally, the grinding wheel is heated by conventional radiant heating, and in this way, in addition to thermal expansion, the stresses combine and form an amplified resultant stress which tends to break up the wheel as it is being heated. Furthermore, since the wheel or other grinding product will also harden from the outside as it is being processed, this will tend to trap the volatile gases as they try to escape, thus blow-outs can occur, particularly if the heating process is carried out quickly.

It is basically for these reasons that conventional kilning, curing and drying of grinding wheels and other grinding products is essentially a slow operation to ensure successful results.

It will thus been seen that in order to maintain a volume production of grinding wheels or other grinding products by either method it is necessary to provide expensive and space consuming ovens or kilns and to use large amounts of fuel to heat them and the associated furniture. Also the ovens or kilns need maintenance as do the trolleys and other furniture on which the products pass through the conventional continuous or semi-continuous flow process.

According to a first aspect of the present invention, there is provided a method of manufacturing a grinding product (as hereinbefore defined), in which the product is formed and subsequently heat-treated for drying, vitrification or curing by microwave heating.

According to a second aspect of the present invention, there is provided a method of manufacturing a grinding wheel consisting of an abrasive material in a vitrified or organic matrix, in which the wheel is formed and subsequently heat-treated for drying, vitrification or curing by microwave heating.

As the term is normally understood, and intended to be understood herein, microwave heating is achieved by application of energy in the form of electromagnetic waves in a frequency range between infra-red and radio frequencies. The technique of microwave heating is well established in various areas of technology, and in order to avoid interference with radar and communications, microwave heating may be carried out only within closely circumscribed and internationally agreed bands of frequency. The principal bands are centred on 2450 MHz (12.2 cm wavelength) and 896 MHz (33.4 cm wavelength).

Use has been made of dielectric heating in the drying vitrified grinding wheels, but this requires accurate tuning of the frequency to be used and therefore is not suitable for large scale industrial uses or mixed loading or batch of products.

By using microwave energy, with the wavelength suitably chosen for adequate penetration into the body of the wheel or other product, it is found that the heating will take place from the inside towards the outside of the material, so that the difficulties of trapping volatiles and vapour are avoided and the heating times may be greatly reduced.

Microwave energy can be made to have a random directional interacting electric field, by bouncing it around a metal enclosure. This results in each molecule of the grinding wheel or other product acting as a microcapacitor which will heat up according to its dielectric constant. Hence, the geometric shape of the product will not inhibit the heating power flowing into the product.

Internal heating is created by the presence of the microwave electromagnetic field that causes rapid oscillation of the dipoles of the molecules of the grinding wheel, causing inter-molecular friction. This will mean that the wheel will heat up from within the material itself to its outside.

As an example, it has been found that using a frequency of about 2500 MHz, i.e. a wavelength of 12 cm, satisfactory results can be obtained.

As a comparison with the conventional heating times, many types of resinoid grinding wheels can be cured in 0.5 hours (30 minutes) as compared with 24 to 36 hours, while drying of vitrified grinding wheels can be achieved in between 0.17 hours (10 minutes) and 1 hour as compared with 84 hours. Similarly, firing of vitrified grinding wheels can be completed in about 4 to 9 hours as compared with 132 hours. Excessively large sizes of grinding wheels may take longer than these times, but their times using conventional process are exceedingly long, e.g. 15 days or more. It will be appreciated that the power input required will vary with the load, to achieve these short cycling times, and it may be more satisfactory from an economic point of view to lengthen the cycle times and thereby reduce equipment costs.

In the heat treating of vitrified grinding wheels or other grinding products, the successive stages of drying and firing may be largely telescoped, thereby avoiding handling, by the expedient of passing the wheels or other products continuously through successive microwave applicators to achieve a preliminary heating, to include an effective drying stage before effectively kilning at a higher energy level.

There are a number of different ways of ensuring that the grinding wheels or other products are subjected to the appropriate heating stages. For instance, a batch or periodic heating system may be adopted in which the products are loaded into a metal enclosure and the microwave power fed into the enclosure and controlled to give the required heating rate or rates.

In an alternative, semi-continuous, method, the products are fed by a walking beam or like stepwise moving conveyor through a metal enclosure divided by metal shutters into separate sections, with a fixed microwave input fed into each of the separate sections, so that as the products are stepped seriatim through the sections they are subjected to appropriate heat treatments.

In a continuous process, the products would pass through a single enclosure on a continuously moving conveyor so that the heating rate would be dependent on the speed of the conveyor. This type of process is not so easily controlled and would only really be suitable for dealing with wheels or other products of similar mass.

As a further advantage of microwave heating, it is now possible to form a grinding wheel with a coaxial metal reinforcing ring, e.g. of steel, completely within the wheel. Microwave energy does not directly heat the steel so that its thermal expansion is limited. In a vitrified grinding wheel formed by the normal process, the ring would melt during firing, but using microwave techniques, this hazard is also avoided. The amount of heat conducted into the ring during the short heating cycles is quite small.

The invention will be further described with reference to the accompanying diagrammatic drawings, which show various forms of apparatus for use in processes according to the invention and in which.

Figure 1:
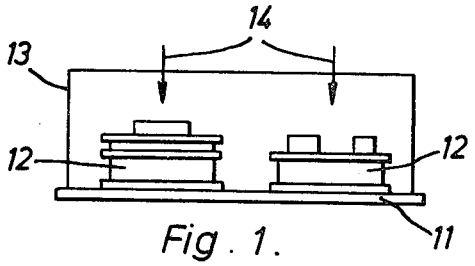
FIG. 1 is an elevation of a batch type of apparatus for heat treatment by microwaves.

FIG. 1 shows the microwave applicator of a batch type comprising a base 11 on which there are shown stacks 12 of grinding wheels for treatment. When the stacks 12 are in position, a metal cover 13 is lowered onto the base 12 to form an enclosure which is sealed against leakage of microwaves. Microwave energy is then fed in through suitable wave guides as indicated by arrows 14 and is reflected around the enclosure and absorbed by the wheels in the stacks 12. The rate of input of the microwave energy is controlled to give the required heating rate. When the energy source is switched off, the cover 13 may be removed for the cooling of the stacks.

Figure 2:
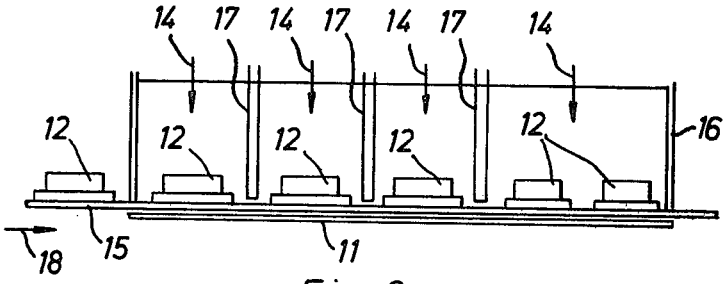
FIG. 2 shows a semi-continuous apparatus.

FIG. 2 shows a semi-continuous form of apparatus in which stacks or individual products 12 are fed in on a walking beam arrangement indicated by 15. A metal cover 16 is provided with shutters 17 so as to define an enclosure which has a number of compartments, each of which has an individual microwave input, again indicated by arrows 14. The separate compartments are substantially sealed from each other so that by appropriate choice of the energy input, the heating rate in the compartment may be controlled and the stacks or products 12 pass successively through the compartments in the direction indicated by the arrow. Thus each of the first three compartments there is a single dwell period and in the last compartment the stacks remain for two dwell periods. By this means, it is envisaged that the stacks may be successively heated to drying temperature, held at drying temperature, heated rapidly to firing temperature and held at firing temperature, after which the cooling cycle commences.

Figure 3:
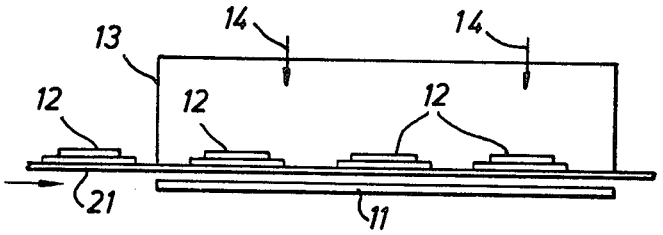
FIG. 3 shows a continuous apparatus.

FIG. 3 shows an arrangement in which a continuously moving conveyor 21 passes through a metal enclosure formed between the base 11 and cover 13. Appropriate sealing against microwave leakage has to be provided at the ingress an egress. Such an arrangement is suitable for individual products or stacks of constant configuration so that the microwave input, as indicated by the arrows 14, will provide the appropriate heating cycle.

Figure 4:
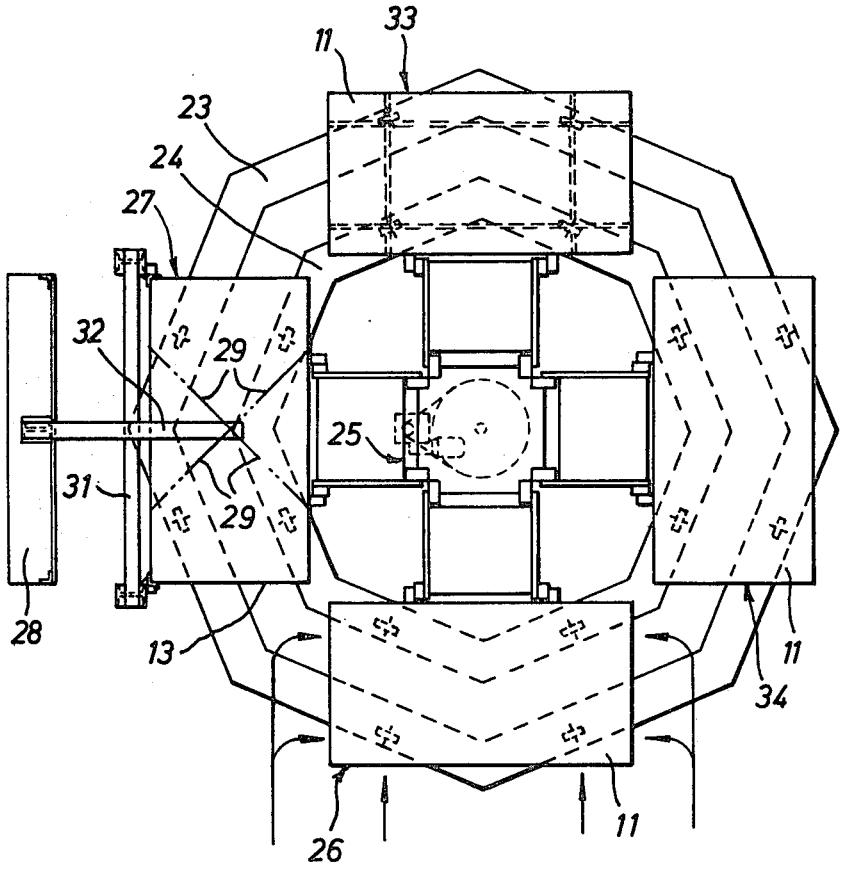
FIG. 4 is a plan view of a batch type installation on a carousel principle.

FIG. 4 shows a carousel arrangement for carrying out batch-type heating along the lines indicated in the description of FIG. 1, followed by appropriate cooling. Four separate bases 11 are formed by carriages running clockwise on guides 23 and 24. The carriages are connected to a central drive arrangement 25 for intermittent stepwise movement on the guides 23, 24. At a first station 26, the products are loaded on the base 11 and then pass to the heat treatment station 27 at which a cover 13 is lowered over the base 11 to form the enclosure. A control console is indicated at 28 and suspension means 29 are shown for the cover 13. The cover is thus suspended from an appropriate gantry 31 by means of an arm 32 and raising or lowering of the cover is controlled from the console 28, as is the supply of microwave energy. Appropriate interlocks are provided to ensure against application of microwave energy while the cover is up, and appropriate cut outs are also provided to ensure that the energy is switched off in the event of failure.

The arrangement is primarily for drying of vitreous products, and for this purpose an air supply has to be circulated through the enclosure. By comparing the moisture content of the input and output air, the state of drying can be monitored, and since the output moisture content has been reduced substantially to the input moisture content, drying may be deemed complete.

At this stage, the microwave input is switched off and the cover lifted and the carousel stepped round once more so as to put a fresh load of products into the heating position. From the heating position, the base 11 passes to a first cooling station indicated by the reference 33 and on the next step is passes through a second cooling station indicated by the reference numeral 34. From the second cooling station 34, the base 11 returns to the loading station 26 where the products are first unloaded and then a fresh batch is loaded on during the course of a single heating cycle.

The invention will now be described with a number of comparative examples of conventional and microwave heating of grinding wheels of different sizes and types.

Conventionally, this type of heat treatment is carried out in static or tunnel kilns or ovens constructed in heavy refractory material, in a tunnel kiln.

The process involves the use of large amounts of kiln or oven furniture which is heated during the process thereby expending energy to no useful purpose.

Power input is typically up to 800 kw and kilns and ovens are always large factory space absorbers.

The treating cycle depends largely on the rate of throughput but it will be understood that for firing of vitreous products an 800 kw tunnel kiln will produce about 12,000 lbs (5500 kg) mass of products fired to 1300° C. per 24 hours. Greater amounts of products treated at lower temperature will be produced.

EXAMPLE 1

A resinoid plain wheel of 610 mm diameter, 76 mm width (thickness) and a hole diameter of 305 mm, having aluminous or silicon carbide abrasive bonded with powder phenolic resin and inorganic fillers conventionally takes about 36 hours to cure and when treated individually by microwave heating can be cured in 0.5 hours (30 minutes).

EXAMPLE 2

A resinoid straight cup wheel of 180 mm diameter 100 mm width and 32.55 mm hole diameter, having aluminous or silicon carbide abrasive bonded with a mixture of powder phenolic and liquid phenolic resin is conventionally cured in about 24 hours and when treated individually by microwave heating can be cured in 0.5 hours (30 minutes).

When dealing with bulk loads of resinoid or other organic product it is envisaged that the 30 minutes curing time will entail very high microwave energy requirements. For bulk operation a 1500 lb (700 kg) mass subjected to a microwave power input of 25 kw should take about 4 hours to reach 200° C.

EXAMPLE 3

A vitrified plain wheel of 500 mm diameter, 150 mm width and 203 mm hole diameter having aluminous or silicon carbide abrasive bonded with a mixture of clays and frit with a felspar flux is dried in a tunnel kiln in about 84 hours (3½ days). Using dielectric heating, which requires accurate tuning to the required resonant frequency in a Radyne heater, a time of 30 minutes has been achieved. Such a wheel treated individually with microwave energy can be dried in about 0.17 hours (10 minutes). However in bulk operations, using a load of about 3000 lb (1350 kg), the microwave power required would be excessive to achieve this time and such a mass could be subjected to 50 kw of increase power input and brought to 100° C. in 2 hours.

EXAMPLE 4

A vitrified plain wheel of 100 mm diameter, 50 mm width and 25 mm hole diameter having aluminous or silicon carbide abrasive bonded with a mixture of clays and frit with a felspar flux can be cured in about 132 hours (5½ days) in a tunnel kiln. Treated individually by microwave heating such a wheel could be fired in 4 to 9 hours depending on the specific material used.

EXAMPLE 5

A vitrified plain wheel of 1150 mm diameter 250 mm width and 305 mm hole diameter, with aluminous or silicon carbide abrasive bonded with a mixture of clays and frits with a felspar flux has a normal firing time in a tunnel kiln of 372 hours (15½ days). Treated individually in a small microwave applicator it could be fired in about 50 hours.

In order to get some comparison with a conventional tunnel kiln used for firing vitreous products it is envisaged that a continuous operation 150 kw microwave applicator could fire a 12,000 lb (5500 kg) mass of products per 24 hours, as compared to the 800 kw used by a comparable tunnel kiln.

Various modifications may be made within the scope of the invention.

I claim:

1. In a method of manufacturing a bonded abrasive product consisting of a shaped body of a vitrified or organic matrix material with abrasive material dispersed therein, comprising the steps of compressing a mass of bonding ingredients containing the dispersed abrasive particles for forming the body to the required shape and subsequently heat treating the compressed body for drying, vitrification and/or curing: the improvement being that the said heat treatment is carried out by microwave heating carried out at a frequency located in a narrow band centered at about 2450 MHz.

2. In the method defined in claim 1, said shaped body being an abrasive grinding wheel.

3. In the method defined in claim 2, said wheel being formed to contain an imbedded reenforcing ring of metal.

4. A method as claimed in claim 1, for manufacturing a vitrified grinding product, in which the product is passed successively through different microwave applicators for drying and vitrification respectively.

5. In the method defined in claim 4, wherein the product is held for a predetermined period in a first microwave applicator until completely dried, and while heated is passed to a second microwave applicator wherein it is held for a greater time whereby it is quickly heated further to vitrification temperature and held there for a longer predetermined time.

6. A method as claimed in claim 1, in which the product is passed in a semi-continuous manner through sections of a metal enclosure, the sections being separated by metal shutters and fed with independent supplies of microwave energy.

7. The method defined in claim 1, wherein the body is disposed in a metal enclosure during microwave heating whereby the body is subjected to randomly directed energy for uniform treatment.

8. In a method of manufacturing a grinding wheel which consists of an abrasive material in a resinoid matrix material which comprises the steps of compressing a mass of particulate matrix material containing dispersed abrasive particles whereby the wheel is first formed into the required shape and subsequently heat treating said shaped wheel for curing the matrix material: the improvement that the said heat treatment is carried out by microwave heating at a frequency of about 2450 MHz.

9. The method defined in claim 8, wherein said matrix material is a mixture containing at least one phenolic resin, and said abrasive is an aluminous or silicon carbide abrasive.

10. In a method of manufacturing a grinding wheel which consists of an abrasive material in a vitrified matrix material which comprises the steps of compressing a mass of particulate matrix material containing dispersed abrasive particles whereby the wheel is first formed into the required shape and subsequently heat treating the shaped wheel for drying and vitrification of the matrix material: the improvement that the said heat treatment during drying is carried out by microwave heating at a frequency of about 2450 MHz.

11. In a method of manufacturing a grinding wheel defined in claim 10: the further improvement being that the said heat treatment during vitrification is carried out by microwave heating at a frequency of about 2450 MHz.

12. The method defined in either claim 10 or claim 11, wherein said matrix is principally a mixture of clay and frit with a suitable flux, and the abrasive is an aluminous or silicon carbide abrasive.

13. In a method of manufacturing a bonded abrasive product consisting of a shaped body of a vitrified or organic matrix material with abrasive material dispersed therein, comprising the steps of compressing a mass of bonding ingredients containing the dispersed abrasive particles for forming the body to the required shape and subsequently heat treating the compressed body for vitrification or curing: the improvement being that the said heat treatment is carried out by microwave heating carried out at a frequency located in a narrow band centered at about 2450 MHz.

* * * * *